United States Patent [19]

Mitchell et al.

[11] 4,391,007

[45] Jul. 5, 1983

[54] MULTI-POSITION WALL SPACER

[75] Inventors: Larry D. Mitchell; Charles W. Keith, Jr., both of Manchester, Mo.

[73] Assignee: B-W Health Products, Inc., Maryland Heights, Mo.

[21] Appl. No.: 222,415

[22] Filed: Jan. 5, 1981

[51] Int. Cl.[3] ..... A61G 7/00

[52] U.S. Cl. ..... 5/60; 5/424; 5/508

[58] Field of Search ..... 5/60–69, 5/424, 429, 430, 508

[56] References Cited

U.S. PATENT DOCUMENTS

| | | | |
|---|---|---|---|
| 1,017,153 | 2/1912 | Kampe | 5/508 |
| 2,490,956 | 12/1949 | Freund | 5/60 |
| 3,644,944 | 2/1972 | Bourgraf et al. | 5/68 X |
| 4,016,613 | 4/1977 | Benoit et al. | 5/508 |
| 4,062,075 | 12/1977 | Stern et al. | 5/68 X |

FOREIGN PATENT DOCUMENTS

| | | | |
|---|---|---|---|
| 563138 | 6/1975 | Switzerland | 5/508 |

*Primary Examiner*—William E. Lyddane
*Assistant Examiner*—Michael F. Trettel
*Attorney, Agent, or Firm*—Gravely, Lieder & Woodruff

[57] ABSTRACT

An adjustable wall-spacer is employed to position an adjustable hospital bed normally from a wall and prevent contact of the headboard with the wall when the bed is moved into raised or tilted positions.

13 Claims, 5 Drawing Figures

11
16
41
42
43
44
45
50
31
30
22
21
20
12
12a
13
A
B
C
4

MULTI-POSITION WALL SPACER

BACKGROUND OF THE INVENTION

This invention relates to an adjustable hospital bed, and more particularly to an adjustable hospital bed having attached thereto a three-position wall spacer adapted to prevent contact between the headboard of the bed and an adjacent wall.

Hospital beds having a relatively fixed frame mounted on castors and supporting a movable frame through head and foot elevating linkages are well known. These adjustable beds commonly have a normal or down position, elevated treatment positions achieved by operating the elevating linkages to raise the movable frame, and extreme tilt positions achieved by operating only the foot elevating linkage (Trendelenberg tilt position) or the head elevating linkage (reverse Trendelenberg tilt position).

When in use, a bed of this type is usually positioned normal to a wall of a room with the headboard adjacent to and spaced slightly away from the wall. The bed may then be employed with the movable frame in a down or normal position or, by operation of the appropriate linkages, the movable frame may be raised into any elevated treatment position or moved into an extreme tilt position as required. When being raised or lowered, the movable frame undergoes a longitudinal motion with respect to the fixed frame. In some bed designs this movement is directed toward the head of the bed when the movable frame is raised; in other designs, movement toward the head of the bed occurs when the movable frame is lowered. Further, when the movable frame is tilted into the Trendelenberg position, the headboard is tilted toward the adjacent wall. Thus there exists the likelihood that during elevating and tilting operations the headboard will be brought into contact with the adjacent wall, resulting in damage to the wall and limiting further travel of the movable frame.

To overcome this problem, one could locate the bed at a distance from the wall sufficient to accommodate movement of the frame into all treatment and tilt positions and locking the castors to prevent an accidental repositioning of the bed. Alternatively, as in some prior art hospital bed designs, a fixed spacer bar could be provided to space the bed a fixed distance from the wall. Either of these approaches will achieve the desired result of preventing contact of the headboard with the adjacent wall. However, positioning the bed away from the wall at a fixed distance sufficient to accommodate movement into the more space-consuming Trendelenberg tilt position wastes a considerable amount of the usually limited available room space when the bed is to be used only in the down or elevated treatment positions. Further, a fixed spacer bar of sufficient length will extend a considerable distance beyond the head of the bed and be a safety hazard when the bed is transported in the down position.

Another prior art method has been to employ rollers or wheels mounted on the headboard and adapted to provide rolling contact between the wall and the headboard during the elevating and tilting operations. The rollers prevent damage to the wall, and, upon further movement of the headboard toward the wall, the bed is urged outwardly from the wall. The outward motion of the bed will be of course accomplished only if the castors upon which the bed rests are not locked to prevent movement. Thus, the castors must be unlocked prior to elevating or tilting the bed, then again locked to prevent an undesired repositioning of the bed.

BRIEF SUMMARY OF THE INVENTION

The instant invention provides a hospital bed with a three-position adjustable wall spacer adaptable to space the bed selectively either of two fixed distances from a wall adjacent to the headboard of the bed, and retractable beneath the movable frame of the bed when the hospital bed is placed in a normal or down position or when being transported. The adjustable wall spacer of this invention comprises spacing means slidably received by support means and engaging latch means. The support means is pivotally attached to the fixed frame of a hospital bed through pivot means, and the latch means operates to hold the wall spacer in any of the three operating positions.

DESCRIPTION OF THE INVENTION

Figure 1:
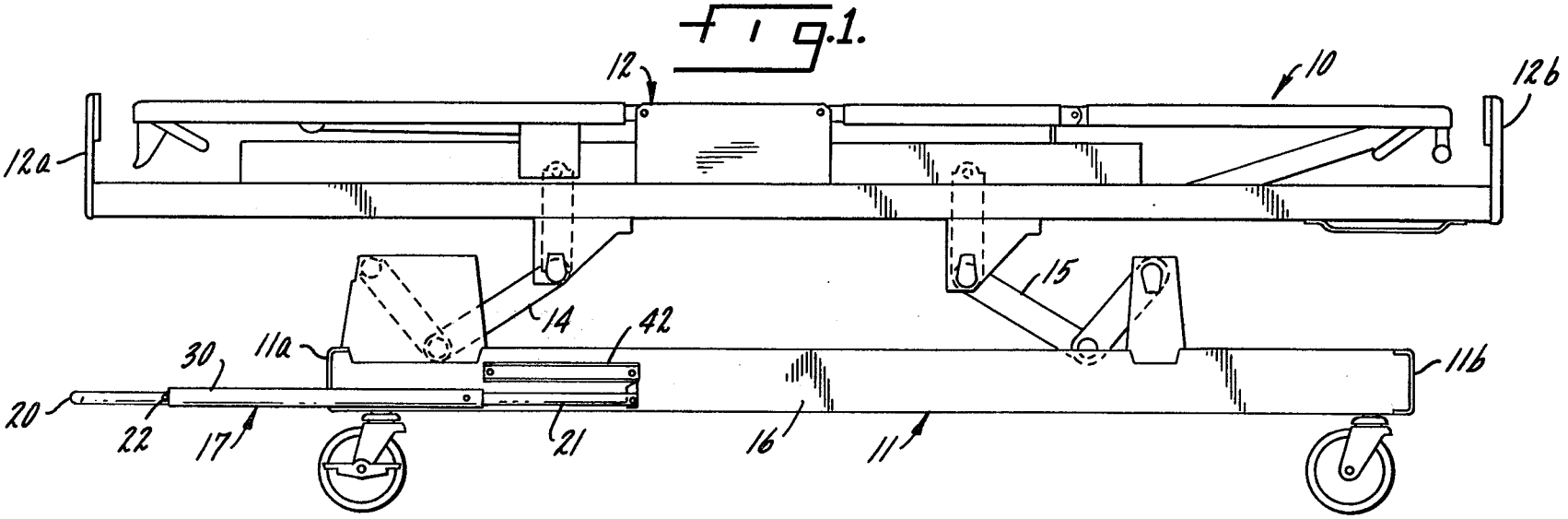
FIG. 1 is a side view of the hospital bed showing the fixed frame with an adjustable wall spacer attached thereto, the elevating linkages, and the movable frame in a raised position.
Figure 5:
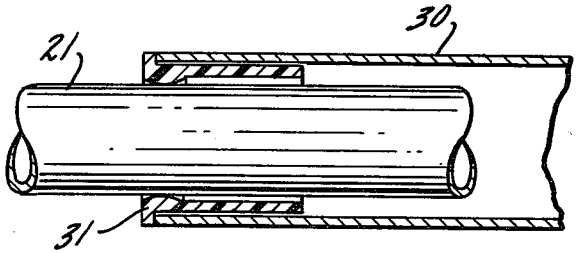
FIG. 5 is a fragmentary view in partial section showing the guide bushing, support means and spacing means.

Referring now to FIG. 1, there is shown a side view of an adjustable hospital bed 10 constructed according to the principles of this invention. Bed 10 includes a relatively fixed frame 11 having a head portion **11*a* and a foot portion 11*b*; a movable frame 12 having a headboard 13 (see FIG. 2) mounted thereon and having a head portion 12*a* and a foot portion 12*b*; an elevating linkage 14 interconnecting the head portions 11*a* and 12*a*; and an elevating linkage 15 interconnecting the foot portions 11*b* and 12*b* of fixed frame 11 and movable frame 12. Fixed frame 11 includes, among other things, a side rail 16 and an opposite second side rail 16' (See FIG. 3**).

The present invention is directed to the adjustable wall spacer, shown generally at 17, which is pivotally mounted on side rails 16, 16' and adapted to provide a plurality of fixed distances between the headboard of the bed and an adjacent wall surface.

Referring now to FIGS. 2–5 inclusive, the adjustable wall spacer 17 comprises a pair of tubes 30, 30' receiving a pair of legs 21, 21' of a U-shaped bumper rod or tube 20. The tubes 30,30' are attached to the side rails 16, 16' respectively by pivot means generally indicated by numerals 50, 50'. Guide bushings 31 are provided in each end of tubes 30, 30' to slidably receive and space the legs 21, 21' of tube 20. Thus, the tubes 30 and 30' and the bushings 31 constitute mounting means for the U-shaped bumper tube 20. The legs 21, 21' of tube 20 are provided with stop pins 22, 22' near one end of tubes 30, 30' and with tenons 41, 41' at the other end thereof. A pair of U-shaped strike members 42, 42' are attached to side rails 16, 16' respectively. Strike members 42, 42' have apertures 43, 43' on the top thereof and elongated notches 44, 44' and apertures 45, 45' on the bottom thereof.

Figure 4:
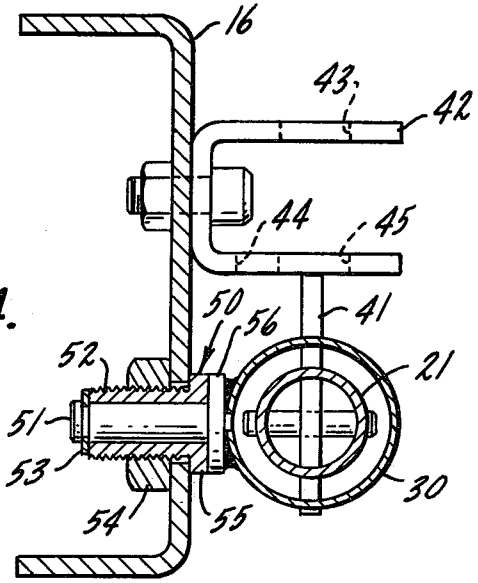
FIG. 4 is a cross-sectional end view of the adjustable wall spacer taken through 4—4 of FIG. 2, and showing the pivot means.

Each of pivot means 50, 50', see FIG. 4, comprises a pin 51, a bushing 52, a lock washer 53 and a fastener 54. Bushing 52, a cylindrical bearing having a stop 55, passes inwardly through a suitable aperture in the fae of one of the side rails 16, 16' and is held in place by fastener 54. Pin 51 having stop 56 is attached to one of the tubes 30, 30' and journalled within bushing 52. Stops 55 and 56 meet and provide operating clearances between the tubes and side rails. Pin 51 passes through bushing 52 and is maintained in place by lock washer 53. Pin 51 is thus rotatable within bushing 52, providing a pivotal motion of the tube 30.

Figures 2, 3:
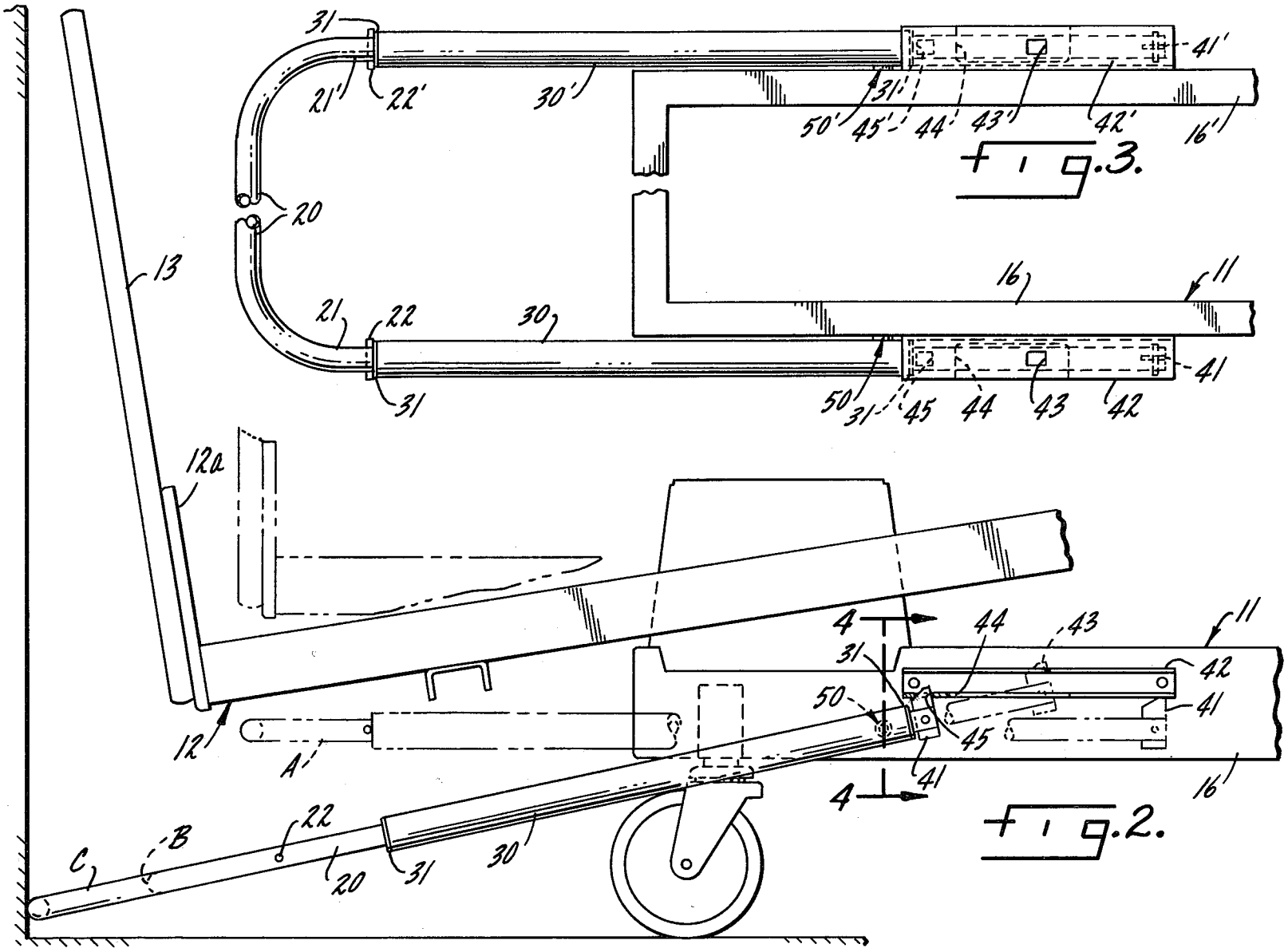
FIG. 2 is a fragmentary elevation view of the bed showing the head portions of the fixed and movable frames showing the down and Trendelenberg positions of the movable frame and attached headboard relative to the adjacent wall, and the adjustable wall spacer including the three operating positions thereof.
FIG. 3 is a fragmentary plan view of the adjustable wall spacer attached to the fixed frame and showing the spacing means, the support means and latch means.

In operation, the adjustable wall spacer 17 may be employed selectively in any of three positions corresponding to the particular intended use of the bed 10. When bed 10 is used in a down position or is to be transported, the wall spacer 17 is retracted beneath the movable frame in a horizontal position, shown as retracted position A by dotted lines in FIG. 2, with tenon 41, 41' resting against the bottom of strike member 42, 42'. When bed 10 is placed in a room with headboard 13 adjacent to a wall of the room and intended for use in an elevated treatment position, the U-shaped rod or tube 20 is extended toward the wall and lowered to the position shown by dotted lines, intermediate position B, in FIG. 2 to engage tenons 41, 41' in apertures 43, 43' of strike plates 42, 42'. When the bed 10 is placed in a room and intended for use in a Trendelenberg tilt position, extended position C, shown by solid lines in FIG. 2, headboard 13 will be tilted outwardly toward the adjacent wall and the head portion 12*a* of movable frame 12 will be displaced downwardly. For use in this position, the rod or tube 21 will be further extended toward the wall and lowered by pivoting the tubes 30, 30' engaging tenons 41, 41' with apertures 45, 45' of strike members 42, 42' as shown in FIG. 2, solid lines. The wall spacer 17 will then extend beyond the furthest reach of headboard 13 to space the bed a fixed distance from the wall and thus prevent contact of headboard 13 with the wall. Thus, the tenons 41 and 41' and the strike members 45 and 45' constitute a latching mechanism for holding the U-shaped bumper tube 20 in its intermediate position B or extended position C.

Operation of the wall spacer shown in the accompanying drawings may be readily accomplished manually, as with the hand or the toe of the shoe. It will be readily apparent that means for automatic positioning of the wall spacer could be included such as, for example, a motor or a linkage coupled to the head elevating linkage which would move the spacer bar into an extended position when the head elevating linkage is actuated. Numerous further modifications and variations of the invention will be apparent to those skilled in the art and the specific embodiments herein described and shown are provided by way of illustration of the instant invention and not in limitation thereof.

We claim:

1. An adjustable hospital bed having a relatively fixed frame having side rails and head and foot portions, a movable frame having a headboard mounted thereon, and having head and foot portions, said bed having a normal position wherein said headboard is substantially parallel with an adjacent wall of a hospital room, elevation linkage interconnecting said movable frame with said fixed frame to elevate said movable frame, said linkage also being adapted to elevate the head portion of said movable frame into a reverse Trendelenberg tilt position, and operable to elevate the foot portion of the movable frame into a Trendelenberg tilt position, and an adjustable wall spacer attached through pivot means to said adjustable frame, said wall spacer comprising:

pivot means;

two tubes having guide bushings provided therein, each of said tubes attached through said pivot means to one of said side rails;

a U-shaped tube having two legs, each of said legs slidably received by said guide bushings;

two tenons, each attached to one leg of said U-shaped tube; and two U-shaped strike members, each attached to one of said side rails and each having an aperture in the top thereof and an aperture and an elongated notch in the bottom thereof, said strike members each positioned to receive a tenon selectively within either of said apertures.

2. An adjustable hospital bed comprising: a base frame having a head end and a foot end; a movable frame located above the base frame and also having a head end and a foot end located respectively above the head end and foot end of the movable frame; means for supporting the movable frame above the base frame and for changing the inclination of the movable frame relative to the base frame such that the head end of the movable frame may be depressed with respect to the foot end of that frame; and a wall spacer located on the base frame at the head end thereof and including a bumper member, mounting means supporting the bumper member on the base frame such that the bumper member can both pivot and extend and retract so as to undergo both translatory and rotational movement with respect to the base frame, the mounting means permitting the bumper member to move between a retracted position wherein the bumper member does not project substantially beyond the head end of the movable frame and an extended position wherein the bumper member projects substantially beyond the head end of the movable frame, and further permitting the bumper member to swing downwardly so as to not interfere with the movable frame when the head end of the movable frame is depressed, and latching means for holding the bumper member firmly in its extended position.

3. A hospital bed according to claim 2 wherein the latching means also holds the bumper member generally horizontal when the bumper member is in its retracted position, and firmly holds the bumper member in a downwardly inclined position when the bumper member is in its extended position.

4. A hospital bed according to claim 2 wherein the latching means also holds the bumper member at one angle when the bumper member is in its retracted position and at another angle when the bumper member is in its extended position, with the other angle being such that the bumper member when in its extended position is generally below the position it assumes when it is in its retracted position.

5. A hospital bed according to claim 4 wherein the latching means holds the bumper member in at least one intermediate position between the retracted and extended positions.

6. A hospital bed according to claim 5 wherein the bumper member when in its intermediate position is held by the latching means at an angle which is substantially the same as the angle at which the bumper member is held when the bumper member is in its extended position.

7. A hospital bed according to claim 3 wherein the mounting means includes tubular members which are pivotally mounted upon the base frame, and the bumper member is fitted into the tubular members such that it telescopes relative to the tubular members between the extended and retracted positions.

8. A hospital bed according to claim 7 wherein the bumper member extends completely through the tubular members when in both the retracted and extended positions, and the latching means includes tenons projected from the bumper member at the ends thereof and strike members mounted upon the base frame and having apertures that are capable of receiving the tenons at the extended position for the bumper member, such that the bumper member is held in a fixed and determined disposition when it is in its extended position.

9. A hospital bed according to claim 8 wherein the strike members have additional apertures which when engaged by the tenons holds the bumper member in the intermediate position.

10. A hospital bed according to claim 5 and further comprising a headboard mounted upon the movable frame and being located in a generally vertical disposition when the movable frame is horizontal, but projecting beyond the head end of the movable frame when the movable frame is inclined such that its head end is depressed; wherein the bumper member, when in its intermediate position, projects beyond the head end of the movable frame and the headboard when the movable frame is horizontal, but not when the movable frame is inclined substantially with its head end depressed; and wherein the bumper member, when in its extended position, projects beyond the furthest reach of the headboard when the movable frame is inclined substantially with its head end depressed.

11. An adjustable hospital bed comprising: a base frame having a head end and a foot end; a movable frame located above the base frame and also having a head end and a foot end which are located respectively over the head end and foot end of the base frame; a headboard attached to the head end of the movable frame and projecting upwardly therefrom; means for supporting the movable frame above the base frame and for further changing the inclination of the movable frame from a horizontal disposition to an inclined disposition in which the head end of the movable frame is depressed with respect to the foot end of the movable frame, whereby the upper end of the headboard will project beyond the head end of the movable frame; and a wall spacer mounted on the base frame at the head end thereof and including a bumper member that is capable of undergoing translatory movement between extended, retracted and intermediate positions, the bumper member when in its extended position projecting beyond the furthest reach of the headboard when the movable frame is inclined with its head end depressed, the bumper member when in its intermediate position projecting beyond the headboard when the movable frame is in a horizontal disposition, but not beyond the headboard when the movable frame is inclined with its head end depressed, the bumper member when in its retracted position being located inwardly from the position it assumes when it is in its intermediate position, and latching means for holding the bumper member firmly in its extended and its intermediate positions.

12. A hospital bed according to claim 11 wherein the wall spacer also includes means for permitting the bumper member to pivot downwardly such that the bumper member is generally lower when in its extended position than when in its retracted position.

13. A hospital bed according to claim 12 wherein the bumper member fits telescopically to the means for permitting the bumper member to pivot downwardly.

* * * * *